US006253926B1

(12) United States Patent
Woodgate

(10) Patent No.: US 6,253,926 B1
(45) Date of Patent: Jul. 3, 2001

(54) MODULAR SCREEN PANEL

(75) Inventor: Raymond Maxwell Woodgate, Melton South (AU)

(73) Assignee: Lettela Pty Limited, Airport West (AU)

( * ) Notice: Subject to any disclaimer, the term of this patent is extended or adjusted under 35 U.S.C. 154(b) by 0 days.

(21) Appl. No.: 09/242,990

(22) PCT Filed: Sep. 5, 1997

(86) PCT No.: PCT/AU97/00576

§ 371 Date: Mar. 17, 1999

§ 102(e) Date: Mar. 17, 1999

(87) PCT Pub. No.: WO98/09738

PCT Pub. Date: Mar. 12, 1998

(30) Foreign Application Priority Data

Sep. 5, 1996 (AU) ..... PO2137

(51) Int. Cl.[7] ..... B07B 1/49

(52) U.S. Cl. ..... 209/399; 209/405; 209/408; 209/409

(58) Field of Search ..... 209/397, 399, 209/405, 408, 409

(56) References Cited

U.S. PATENT DOCUMENTS

| | | | | |
|---|---|---|---|---|
| 2,068,413 | | 1/1937 | Hunsicker . | |
| 3,980,555 | * | 9/1976 | Freissle | 209/408 |
| 4,120,784 | * | 10/1978 | Hassal | 209/399 |
| 4,219,412 | * | 8/1980 | Hassal | 209/399 |
| 4,265,742 | * | 5/1981 | Bucker et al. | 209/399 |
| 4,383,919 | * | 5/1983 | Schmidt | 209/399 |
| 4,409,099 | * | 10/1983 | Wolff | 209/399 |
| 4,486,302 | * | 12/1984 | Jorgensen | 209/399 |
| 4,661,245 | * | 4/1987 | Rutherford et al. | 209/399 |
| 4,674,251 | * | 6/1987 | Wolff | 52/309.15 |
| 4,757,664 | * | 7/1988 | Freissle | 52/509 |
| 4,882,044 | * | 11/1989 | Freissle | 209/319 |

(List continued on next page.)

FOREIGN PATENT DOCUMENTS

| | | | |
|---|---|---|---|
| 66006/86 | | 6/1987 | (AU) . |
| 26561/88 | | 4/1990 | (AU) . |
| 80172/91 | * | 9/1992 | (AU) . |
| 46121/93 | * | 2/1993 | (AU) . |
| 44729/93 | * | 2/1994 | (AU) . |
| 77626/94 | | 5/1995 | (AU) . |
| 79080/94 | | 6/1995 | (AU) . |
| 2050633 | * | 3/1993 | (CA) . |
| 4200304 | | 7/1993 | (DE) . |
| 578893 | | 10/1924 | (FR) . |
| 1447714 | | 8/1976 | (GB) . |
| 2203061 | | 10/1988 | (GB) . |
| 2245191 | | 1/1992 | (GB) . |
| WO 81/02398 | | 9/1981 | (WO) . |

*Primary Examiner*—Donald P. Walsh
*Assistant Examiner*—David A Jones
(74) *Attorney, Agent, or Firm*—Merchant & Gould P.C.

(57) ABSTRACT

A screen panel module for mounting on a screen deck frame for screening, separating and grading materials such as ores. The module comprises a stiff frame component for supporting a resiliently flexible screening surface provided by a panel component. Opposite sides of the panel component include depending flanges having ribs for seating in complementary grooves in sides of the frame component for removably mounting the panel component on the frame component. The module includes means such as ribs, grooves, beads or the like, preferable associated with both the panel and frame components for interengaging with fixing means for locating and fixing the module to a screen deck frame. Whereas the whole of a prior art screen module has to be exchanged when worn, the invention allows the exchange of one component of a module, namely the panel component, which component costs a fraction of the whole module.

20 Claims, 3 Drawing Sheets

U.S. PATENT DOCUMENTS 4,885,040 * 12/1989 Wolff ..... 156/244.18
4,960,510 * 10/1990 Wolff ..... 209/405
5,085,324 * 2/1992 Dehlen ..... 209/399
5,326,471 7/1994 Pietzsch .
5,377,846 * 1/1995 Askew ..... 209/405
5,385,241 * 1/1995 Bokor ..... 209/399
5,464,101 * 11/1995 Freissle ..... 209/405
5,664,685 * 9/1997 Freissle ..... 209/399
5,755,334 * 5/1998 Wojcik et al. ..... 209/399
5,988,397 * 11/1999 Adams et al. ..... 209/401

* cited by examiner

MODULAR SCREEN PANEL

The present invention relates to screening apparatus and more particularly to a modular screen panel for use in such apparatus.

Screening apparatus of the type with which the invention is concerned is generally used for screening, grading, or separating materials such as ores and comprises an array of screen panels removably fixed to a frame to provide a continuous screen deck. This deck is vibrated to move bulk materials over and through its screening surface and generally it is desirable that the screening surface be resiliently flexible such that the vibration of the frame sets up a secondary vibration in the screening surface. This secondary vibration is desirable because it assists in overcoming the problem of the screen becoming clogged. However the panels must also be sufficiently stiff to support the material and provide for structural integrity of the apparatus.

It is known to form screen panels in one piece by moulding a resilient plastics material. However a problem with these moulded panels is that stiffness is provided at the expense of flexibility and generally the provision of a requisite degree of stiffness results in the screening surface of the panels having a low degree of flexibility. It is also known to provide stiffness by embedding steel reinforcement members in the plastics material along the sides of the panel, as exemplified by Australian Patent No. 577767 (66006/86). However this increases the expense of the panels, which are consumable items.

The screen panels in a screen deck can be subjected to quite harsh wear, depending on the materials being screened, and thus require periodical replacement. Indeed, the ready exchangeability of worn screen panels for new panels is characteristic of screening apparatus of the type with which the invention is concerned and is a factor which has led to reduced operating costs for such apparatus. However the cost of individual screen panels remains as a significant component of the operating costs for this apparatus.

It is an object of the present invention to provide a screen panel which may have a relatively highly flexible screening surface and which allows for a significant reduction in the replacement costs for a panel.

According to a first aspect of the present invention there is provided a screen panel module for mounting on a screen deck frame for screening, separating or grading materials such as ores, the module including: a resiliently flexible panel component providing a screening surface; a frame component on which the panel component is removably mounted, the frame component fitting under and providing a stiff support for the panel component; and means along at least two opposite sides of the module for interengaging with fixing means for locating and fixing the module to a screen deck frame.

The means for interengaging with fixing means may be provided by the panel component, the frame component or both components, preferably, however such means are provided by both the panel component and the frame component.

Other aspects of the invention include the provision of a panel component per se, a frame component per se, and screening apparatus that includes at least one of the modular screen panels.

The frame component may be a square or rectangular shaped moulding of resilient plastics material and may include reinforcing members embedded in the plastic. The panel component may also be moulded from a resilient plastics material and preferably includes a depending flange along at least two opposite sides, wherein each flange includes elements for interengaging with complementary elements along corresponding sides of the frame component for removably mounting the panel component on the frame component. These interengaging elements may be ribs, grooves, beads or the like for providing a snap fit engagement action for the panel component on the frame component. Preferably each side of the frame component includes a groove and each depending flange of the panel component includes a complementary rib for seating in the grooves. This removable interconnection for mounting the panel component on the frame component to form a screen panel module does not employ or require any additional or external fixing means and allows ready and easy interchange of a panel component on a frame component. Although both the panel component and the frame component are subject to wear, the panel component wears much more quickly and thus requires more frequent replacement than the frame component. The invention allows for this frequent replacement of the worn component to occur independently of replacement of the frame component and it will be understood that this confers a significant saving in the maintenance costs for screening apparatus that employs two part modules according to the invention. Whereas the whole of a prior art screen module has to be exchanged when worn, the invention allows the exchange of only one component of a module which component costs a fraction of the whole module.

The invention also allows manufacturers more scope to tailor the properties of the panel component to suit particular applications or materials. Thus its flexibility and/or surface hardness characteristics may be established independently of the frame component. Furthermore, the means for removably mounting the panel component on the frame component, particularly a snap-fit type of interconnection as described above, does not reduce the flexibility of the interconnection to the same extent as occurs with prior art integrally moulded panels. For example, for a screen module that is to be used for screening bulk material having a high clay content, which tends to be sticky, the panel component can be made sufficiently flexible and be removably mounted on a frame component such that the secondary vibration in the screening surface is of greater amplitude than that which occurs in prior art panels. This greater amplitude secondary vibration reduces the problem of the clay-like material binding to the screening surface and clogging the screen.

Preferably the means along the at least two opposite sides of the module (which will be the sides that don't include the means for removably mounting the panel component on the frame component) for interengaging with fixing means for locating and fixing the module to a screen deck frame, are also elements in the nature of ribs, grooves, beads or the like for preferably providing a snap-fit engagement action for the screen panel module with complementary elements on the fixing means. The fixing means preferably includes a U-shaped fixing rail attached to the screen deck frame and an elongate retaining member for plugging into the channel provided by the U rail. Preferably both the fixing rail and the retaining member include elements in the form of ribs and grooves for interengaging with complementary ribs and grooves on both the panel component and the frame component of the screen panel module.

This preferred form of fixing means for the panel module, wherein both the frame component and the panel component are engaged, provides a more secure fixation for the module than would be the case if only the frame component or the panel component were engaged, although the invention encompasses embodiments wherein only the frame component or only the panel component is engaged. The preferred form of fixing means also allows for ready removal of a module from the screen deck. Thus, the invention allows for quick removal of a module from a screen deck and quick replacement of a worn panel component of that module, followed by quick replacement of the "repaired" module in the screen deck.

For a better understanding of the invention in all its aspects, embodiments thereof will now be described, by way of non-limiting example only, with reference to the accompanying drawings.

In the drawings

Figure 1:
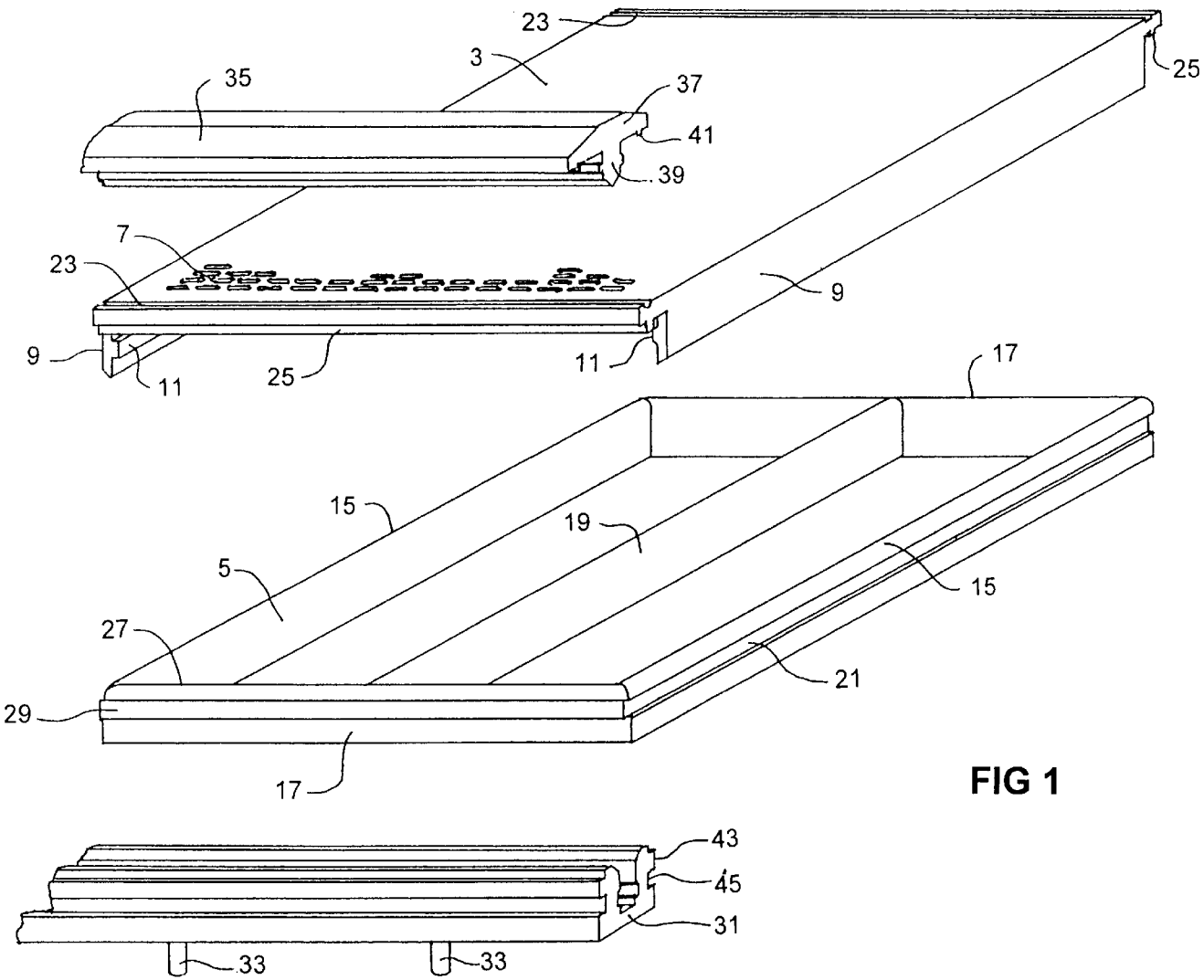
FIG. 1 is an exploded perspective view of a screen panel module according to the invention and fixing means for locating and fixing the panel module to a screen deck frame.
Figure 2:
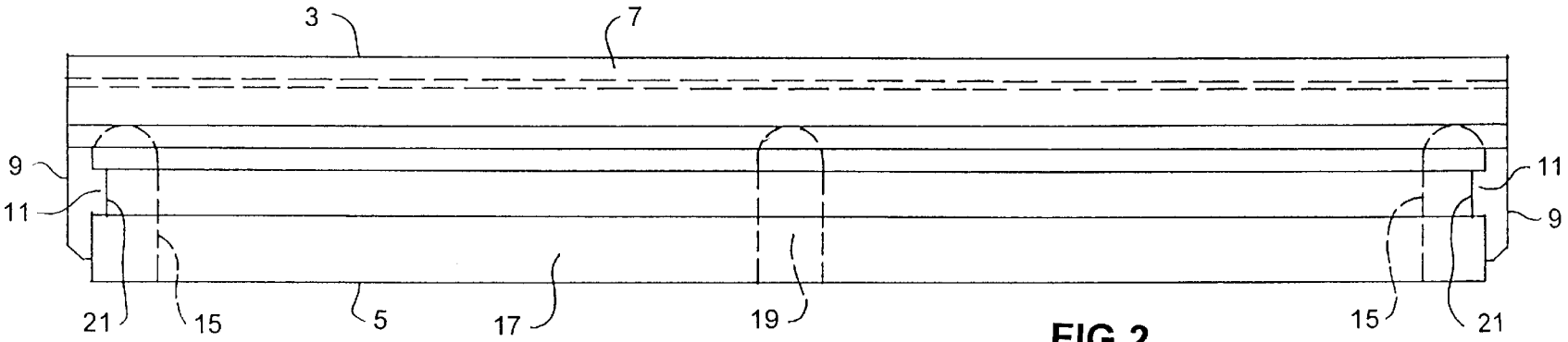
FIG. 2 is a side view of the panel module of FIG. 1

A screen panel module 1 according to an embodiment of the invention as shown in FIG. 1 comprises a panel component 3 and a frame component 5. The panel component 3 is preferably moulded from a resilient plastics material, such as polyurethane, although it may be made from other suitable resilient materials, for example rubber, and includes a screening surface 7 that includes, as is known, screening apertures for allowing passage of bulk material as determined by the sizing of the apertures. The panel component may also be a composite structure comprising an array of apertured panel segments arranged side by side and held together by a resilient binding material. The panel component includes a depending flange 9 along two opposite sides and each flange includes a rib 11 along the length of the inner facing surfaces of the flanges 9.

Figure 3:
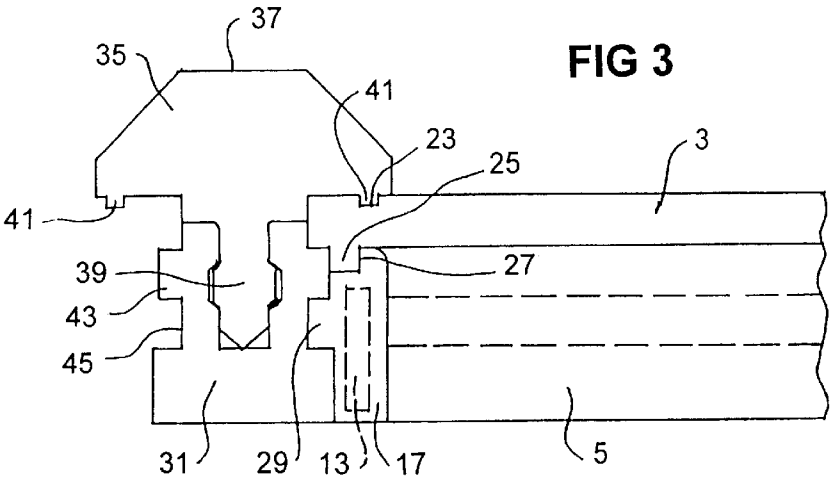
FIG. 3 is an end view of portion of the panel module of FIG. 1 engaged with a fixing means.

The frame component 5 may also be moulded from a resilient plastics material, such as polyurethane, or another suitable material including rubber, and may include metal reinforcement members 13 (see FIG. 3) embedded within its sides 15 and ends 17. The frame may also include a substantially centrally located cross-rib 19 for supporting the panel screening surface 7. It is to be understood that the frame 5 could be formed from other materials that may or may not incorporate reinforcement such as members 13, and that one or more cross-ribs 19 which may extend lengthwise or widthwise of the frame, or both ways, may be provided. Also the invention includes a frame 5 that does not include any ribs 19.

The outer facing surfaces of the opposite sides 15 of frame 5 each include a longitudinal groove 21 for seating the rib 11 of a flange 9 of the panel component 3. Thus the panel component 3 is removably mountable on the frame component 5 by fitting the panel 3 over the frame 5 such that ribs 11 engage in grooves 21. The resiliency and dimensioning of the interengaging parts may be such as to provide for a snap-fit of the panel component 3 onto the frame component 5.

Panel component 3 at each opposite end portion includes a groove 23 in upper surface 7 and a rib 25 depending from its undersurface. Frame component 5, along each end 17, includes a groove 27 along the upper edge and a rib 29 along each end at about mid height. The grooves 23 and 27 and ribs 25 and 29 comprise means for engaging with fixing means for locating and fixing a screen panel module to a screen deck frame, as will be described below.

A fixing means for securing an array of screen panel modules 1 to a frame includes a U shaped fixing rail 31, which includes depending bolts (represented by reference 33 in FIG. 1) for securing the rail to the frame (not shown) of the screening apparatus, and an elongate retaining member 35 that plugs into the channel formed by the legs of the rail 31 forming the U shape. The fixing rail 31 and retaining member 35 are preferably moulded from a resilient plastics material, such as polyurethane, such that the plugging of the member 35 into rail 31 serves to clamp a screen panel module 1 in position. It will of course be understood that an array of panel modules forming a screen deck will require at least two and possibly more fixing means 31–35 (depending on the number of modules across the width of the deck) running parallel to each other along the length of the deck.

The fixing means 31–35 include complementary ribs and grooves for interengaging with the ribs and grooves of the frame 5 and panel 3 components of the screen panel module 1. Thus, with reference to FIG. 3, retaining member 35, which includes a cover portion 37 and a plug portion 39, includes a rib 41 on an undersurface of the cover portion for engaging in a groove 23 of the panel component 3. Also K will be seen from FIG. 3 that rib 25 of panel 3 seats within groove 27 of frame 5 and that a rib 43 of fixing member-31 seats in a groove that is formed between rib 29 of frame 5 and the undersurface of panel 3 by the seating of the rib 25 in groove 27. Fixing member 31 also includes a groove 45 for receiving the rib 29 of frame 5.

It is to be understood that the particular fixing means described above is one example only of a suitable fixing arrangement for modular panels according to the invention and that other suitable fixing arrangements could be provided. Such another fixing arrangement may include use of a fixing rail and retaining member similar to parts 31 and 35 described above, but having a different arrangement of connection elements (that is, ribs and grooves or the like) for interengaging with complementary elements of the panel 3 and the frame 5 components.

Figure 4:
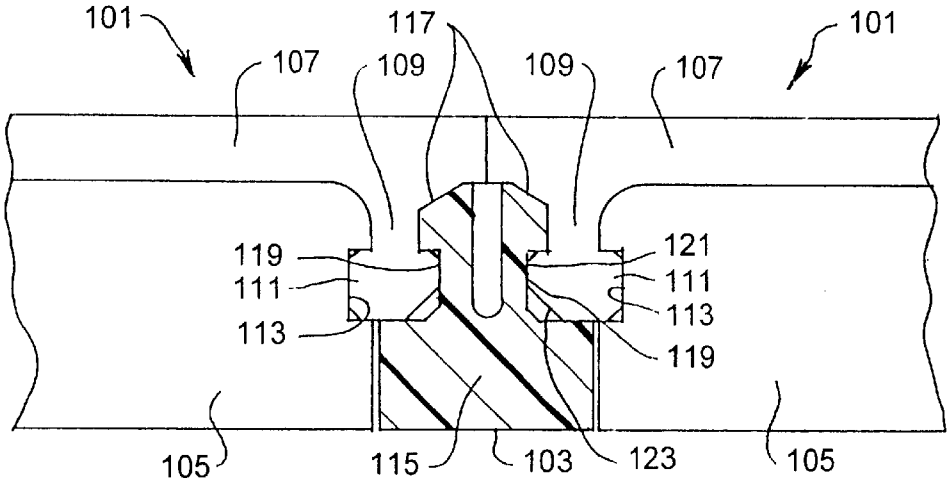
FIG. 4 is a view similar to FIG. 3 illustrating another embodiment of a fixing arrangement for screen panels according to the invention.

In an alternative embodiment, as illustrated by FIG. 4, two side-by-side screen panel modules 101 are shown engaging with fixing means 103 for locating and fixing the modules to a screen deck frame (not shown). Each screen panel module 101 includes a frame component 105 on which a panel component 107 is removably mounted by means of the panel component including a depending flange 109 having a broad rib 111 at the foot of the flange which extends along the inner facing surface thereof (a similar flange on the opposite side of each panel module is not shown). Each frame component includes a recess 113 within which the broad rib 111 seats to provide for the removable mounting. The fixing means 103 is a rail which comprises a base 115 having two upstanding resilient sections 117 each of which is shaped, in conjunction with the base 115, to provide a recess 119. The flange 109 includes another broad rib 121, opposite the broad rib 111, which seats in recess 119. Thus the ribs 111 (which may be chamfered as indicated by reference 123) provide means along at least two opposite sides of a module 101 for interengaging with a fixing means 103 for locating and fixing the module to a screen deck frame. It will be appreciated that with this embodiment, the ribs 121, that is the means for interengaging with the fixing means 103, are provided by only the panel component 107.

Figure 5:
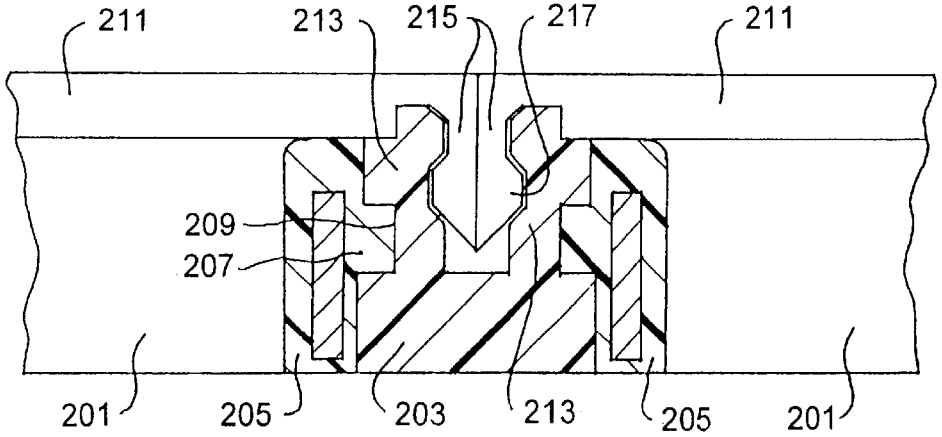
FIG. 5 is a view similar to FIG. 4 illustrating yet another embodiment of a fixing arrangement.

In a further embodiment as illustrated by FIG. 5, two screen panel modules 201 are shown interengaging with fixing means 203 for locating and fixing the modules to a screen deck frame (not shown). In this embodiment the frame component 205 of each module includes a broad rib 207 which seats within a complementary recess 209 in the fixing means 203. The panel component 211 of each module extends over an upstanding section 213 of the fixing means and includes a depending flange 215 having an enlarged end 217 for plugging into, in combination with an adjacent panel component, a complementary recess in the fixing means defined by the two upstanding sections 213. It will be appreciated that with this embodiment, the ribs 207 and flanges 215–217, that is the means for interengaging with the fixing means 203, are provided by both the frame component 205 and the panel component 211.

The invention described herein is susceptible to variations, modifications and/or additions other than those specifically described and it is to be understood that the invention includes all such variations, modifications and/or additions which fall within the spirit and scope of the following claims.

What is claimed is:

1. A screen panel module for mounting on a screen deck frame for screening, separating or grading ore materials, the module comprising:

(i) a resiliently flexible panel component including:

(a) a screening surface having screening, apertures therethrough for allowing passage of bulk ore materials as determined by the sizing of the apertures;

(b) at least two opposite edges; and (c) flanges extending along and depending from the at least two opposite edges, the depending flanges facing inwardly toward one another;

(ii) a frame component on which the panel component is removably mounted in order to provide a stiff support for the panel component, the frame component including:

(a) at least two opposite edge sides facing outwardly away from one another;

wherein the frame component is fitted beneath the screening surface and inside between the depending flanges so that the panel component extends over the frame component with the depending flanges extending outside the frame component down over the opposite sides thereof, the inwardly facing depending flanges engaging with the outwardly facing edge sides to mount the panel component on the frame component; and (iii) means along at least two opposite edges of the panel component for interengaging with fixing means for locating and fixing the module to a screen deck frame.

2. A module as claimed in claim 1, wherein both the panel component and the frame component provide said means for interengaging with the fixing means.

3. A module as claimed in claim 1, wherein the depending flanges include elements for interengaging with complementary elements along the opposite edge sides of the frame component to mount the panel component to the frame component.

4. A module as claimed in claim 3, wherein the elements are ribs, grooves or beads.

5. A module as claimed in claim 3, wherein the interengaging elements provide for a snap-fit engagement of the panel component onto the frame component.

6. A module as claimed in claim 3, wherein each interengaging element of the depending flanges includes a rib, and each interengaging element on the opposite edge sides of the frame component includes a complementary groove for seating a respective rib therein.

7. A module as claimed in claim 6, wherein each depending flange has an inwardly facing surface extending therealong and the ribs extend along the inwardly facing surfaces, and each edge side of the frame component has an outwardly facing surface extending therealong and the grooves extend along the outwardly facing surfaces to receive and seat the ribs therein.

8. A module as claimed in claim 1, wherein the means along the at least two opposite edges for interengaging with fixing means for locating and fixing the module to a screen deck frame are located along edges of the panel component that do not have the depending flanges extending therealong.

9. A module as claimed in claim 8, wherein said means for interengaging with fixing means are elements comprising ribs, grooves or beads.

10. A module as claimed in claim 9, wherein the elements for interengaging with fixing means provide for a snap fit engagement of the screen panel module with complementary elements on the fixing means.

11. A module as claimed in claim 10, wherein the panel component includes a groove in its upper surface along each of said two opposite edge sides, not including the depending flanges, and a rib depending from its undersurface along the same sides.

12. A module as claimed in claim 11, wherein the frame component includes a groove at each side edge for receiving the ribs depending from the undersurface of the panel component, and a rib on the outer facing surfaces of the same sides.

13. A module as claimed in claim 1, wherein the frame component includes at least one cross-rib for supporting the panel screening surface.

14. A module as claimed in claim 1, wherein the panel component is a moulding of resilient plastics material.

15. A module as claimed in claim 1, wherein the frame component is a moulding of resilient plastics material.

16. Screening apparatus for screening, separating or grading ore materials, the apparatus comprising:

(A) a screen deck frame;

(B) at least one screen panel module positioned on the screen deck frame, the module including:

(i) a resiliently flexible panel component including:

(a) a screening surface having screening apertures therethrough for allowing passage of bulk ore materials as determined by the sizing of the apertures;

(b) at least two opposite edges; and (c) flanges extending along and depending from at least two opposite edges, the depending flanges facing inwardly toward one another;

(ii) a frame component on which the panel component is removably mounted in order to provide a stiff support for the panel component, the frame component including:

(a) at least two opposite edge sides facing outwardly away from one another; wherein the frame component is fitted beneath the screening surface and inside between the depending flanges so that the panel component extends over the frame component with the depending flanges extending outside the frame component down over the opposite edge sides thereof, the inwardly facing depending flanges engaging with the outwardly facing edge sides to mount the panel component on the frame component; and (iii) interengaging means along at least two opposite edges of the panel component; and (C) fixing means interengaging with the interengaging means to locate and fix the module to the screen deck frame.

17. A resiliently flexible panel component of a screen panel module for mounting on a screen deck frame for screening, separating or grading ore materials, the panel component comprising:

(i) a screening surface having screening apertures therethrough for allowing passage of bulk ore materials as determined by the sizing of the apertures;

(ii) at least two opposite edges;

(iii) flanges extending along and depending from the two opposite edges, the depending flanges facing inwardly toward one another;

the panel component being removably mountable on a frame component in order to provide a stiff support for the panel component, the panel component extending over the frame component with the depending flanges extending outside the frame component down over opposite edge sides thereof so that the frame component is fitted beneath the screening surface and inside between the depending flanges, the inwardly facing depending flanges engaging with the outwardly facing edge sides to mount the panel component on the frame component; and (iv) means along at least two opposite edges of the panel component for interengaging with fixing means for locating and fixing the panel component to a screen deck frame.

18. A screen panel module for mounting on a screen deck frame for screening, separating or grading ore materials, the module comprising:

(i) a resiliently flexible panel component including:

(a) a screening surface having screening apertures therethrough for allowing passage of bulk ore materials as determined by the sizing of the apertures;

(b) two opposite edges;

(c) two opposite ends extending between the opposite edges; and (d) flanges extending along and depending from the at least two opposite edges, the depending flanges facing inwardly toward one another;

(ii) a frame component on which the panel component is removably mounted in order to provide a stiff support for the panel component, the frame component including:

(a) two opposite edge sides facing outwardly away from one another;

wherein the frame component is fitted beneath the screening surface and inside between the depending flanges so that the panel component extends over the frame component with the depending flanges extending outside the frame component down over the opposite edge sides therof, the inwardly facing depending flanges engaging with the outwardly facing edge sides to mount the panel component on the frame component; and (iii) means along the two opposite ends of the panel component for interengaging with fixing means for locating and fixing the module to a screen deck frame.

19. A module as claimed in claim 18, wherein the frame component has two opposite ends extending between the edge sides, and the means for interengaging with the fixing means is also along the two opposite ends.

20. A screen panel module for mounting on a screen deck frame for screening, separating or grading ore materials, the module comprising:

(i) a resiliently flexible panel component including:

(a) a screening surface having screening apertures therethrough for allowing passage of bulk ore materials as determined by the sizing of the apertures;

(b) two opposite edges;

(c) two opposite ends extending between the opposite edges;

(d) flanges extending along and depending from the at least two opposite edges, each depending flange having an inwardly facing surface extending therealong; and (e) ribs extending along the inwardly facing surfaces;

(ii) a frame component on which the panel component is removably mounted in order to provide a stiff support for the panel component, the frame component including:

(a) two opposite sides, each side edge having an outwardly facing surface extending therealong;

(b) grooves extending along the outwardly facing surfaces; and (c) two opposite ends extending between the edge sides;

wherein the frame component is fitted beneath the screening surface and inside between the depending flanges so that the panel component extends over the frame component with the depending flanges extending outside the frame component down over the opposite edge sides thereof, the ribs being received and engaging in the grooves to mount the panel component on the frame component; and (iii) means along the two opposite ends of the panel component and the two opposite ends of the frame component for interengaging with fixing means for locating and fixing the module to a screen deck frame.

* * * * *